US006848387B1

(12) United States Patent
Zalanka

(10) Patent No.: US 6,848,387 B1
(45) Date of Patent: Feb. 1, 2005

(54) SUNSHADE

(76) Inventor: Craig Zalanka, 2231 Lockwood Meadows St., Sarasota, FL (US) 34234

( * ) Notice: Subject to any disclaimer, the term of this patent is extended or adjusted under 35 U.S.C. 154(b) by 0 days.

(21) Appl. No.: 10/752,629

(22) Filed: Jan. 7, 2004

(51) Int. Cl.[7] ..... B63B 17/00
(52) U.S. Cl. ..... 114/361; 135/120.1
(58) Field of Search ..... 114/361; 135/88.01, 135/120.1, 120.4, 141, 155

(56) References Cited

U.S. PATENT DOCUMENTS

| | | | | |
|---|---|---|---|---|
| 3,032,046 | A | 5/1962 | Coonradt | |
| 4,706,599 | A | * 11/1987 | Johnson | 114/361 |
| 4,781,411 | A | 11/1988 | Kolb | |
| 4,865,381 | A | 9/1989 | Van Rogue | |
| 5,121,703 | A | 6/1992 | Smith | |
| 5,240,020 | A | 8/1993 | Byers | |
| 5,419,604 | A | 5/1995 | Clark | |
| 5,579,797 | A | 12/1996 | Rogers | |
| 5,918,613 | A | 7/1999 | Larson | |
| 5,983,824 | A | 11/1999 | Hernandez | |
| 6,349,666 | B1 | 2/2002 | Hastings | |
| 6,439,150 | B1 | 8/2002 | Murphy et al. | |

* cited by examiner

*Primary Examiner*—Jesus D. Sotelo
(74) *Attorney, Agent, or Firm*—Charles J. Prescott

(57) ABSTRACT

A low sun angle shade preferably adapted to be attached to and carried on a rigid side or end margin of a bimini top, T-top and the like for a boat. The sunshade includes an elongated shade panel formed of substantially opaque material and pivotal connectors on one longitudinal margin of the shade panel adapted for attachment to, and selected pivotal movement of, the shade panel with respect to the side or end margin of the bimini top or T-top. The shade panel is thereby selectively pivotally moveable about a pivotal axis passing through the pivotal connectors between a deployed or outstretched downwardly extending position with respect to the bimini top or T-top wherein low-to-the-horizon sun is substantially block from a boat operators or passengers eyes and a stored position doubled over and positioned against a corresponding side or end portion of the bimini top or T-top. Collapsible embodiments are also provided.

5 Claims, 5 Drawing Sheets

SUNSHADE

CROSS-REFERENCE TO RELATED APPLICATIONS

Not applicable

STATEMENT REGARDING FEDERALLY SPONSORED RESEARCH OR DEVELOPMENT

Not applicable

INCORPORATION-BY-REFERENCE OF MATERIAL SUBMITTED ON A COMPACT DISC

Not applicable

BACKGROUND OF THE INVENTION

1. Field of the Invention

This invention relates generally to bimini tops and T-tops for boats and open-sided generally horizontal shade cover assemblies for vehicles, and more particularly to a low sun angle sunshade attachable to a side or end margin of such tops.

2. Description of Related Art

Horizontally disposed sun covers for boats and other conventional land vehicles are well known and in widespread use. With respect to boats, such sun covers are in the form of flexible fabric bimini tops having rigid aluminum or stainless steel tubular bows for structural support or T-tops formed of rigid segments of tubular welded aluminum or stainless steel which provide a more rigid permanent overhead weather and sun cover structure therefor. With respect to conventional land vehicles, completely open-sided sun covers are also well known for utility vehicles such as lawn mowers, tractors and the like, providing sun protection for the operator of such land vehicles. A number of prior art devices associated with overhead shade cover assemblies and devices are disclosed in the following U.S. Patents:

U.S. Pat. No. 6,439,150 Murphy

U.S. Pat. No. 5,419,604 Clark

U.S. Pat. No. 5,121,703 Smith

U.S. Pat. No. 4,781,411 Kolb

U.S. Pat. No. 2,032,046 Coonradt

U.S. Pat. No. 5,240,020 Byers

U.S. Pat. No. 5,983,824 Hernandez

U.S. Pat. No. 4,865,381 Van Rogue

U.S. Pat. No. 5,918,613 Larson

U.S. Pat. No. 6,349,666 Hastings

U.S. Pat. No. 5,579,797 Rogers

Of particular interest is the sun cover assembly disclosed in U.S. Pat. No. 6,439,150 by Murphy. This disclosure teaches a sun cover assembly adapted to be carried on the tower of a boat positioned above the cockpit area.

A sunshade attachment invented by Van Rogue in U.S. Pat. No. 4,865,381 teaches a sunshade attachment for a lounging chair formed of tubular aluminum structure suitable for attachment thereto at the upper transverse portion of the support back area of such chairs.

A clear view hard curtain device is disclosed in U.S. Pat. No. 5,121,703 invented by Smith. This invention is directed to a plurality of separable frames each including one semi-rigid clear flat panel and a flexible frame surrounding the panel. A pivotal visor for marine vessels is disclosed by Clark in U.S. Pat. No. 5,419,604 teaching a visor/windshield assembly for mounting on a vessel.

During the early morning and late evening time periods, the sun, being low to the horizon, causes sunlight to strike the eyes and face of a boat or vessel operator even when positioned beneath a bimini top or a T-top. These tops are typically substantially horizontally oriented to shield passengers and operator primarily from direct overhead sunlight during the central part of the day. Additionally, even during the mid portion of the day, sunlight reflecting from the water surface will also shine into the eyes and face and upper torso of a user causing undesired sunburns and sore eyes and obstructed vision.

The present invention specifically this heretofore unsatisfied need of providing sunshade into the face and eyes of a user both with respect to low sun angle, the elements, and reflected light form the water's surface.

BRIEF SUMMARY OF THE INVENTION

This invention is directed to a low sun angle sunshade preferably adapted to be attached to and carried on a rigid side or end margin of a bimini top or T-top for a boat. The shade includes an elongated shade panel formed of substantially opaque material and pivotal connectors on one longitudinal margin of the shade panel adapted for attachment to, and selected pivotal movement of, the shade panel with respect to the side or end margin of the bimini top or T-top. The shade panel is thereby selectively pivotally moveable about a pivotal axis passing through the pivotal connectors between a deployed or outstretched downwardly extending position with respect to the bimini top or T-top wherein low-to-the-horizon sun is substantially blocked from a boat operators or passenger's eyes and a stored position doubled over and positioned against a corresponding side or end portion of the bimini top or T-top or frame therefor. Collapsible embodiments are also provided.

It is therefore an object of this invention to provide an accessory attach ment to either a bimini top or a T-top of a boat and other sun cover assemblies for land vehicles and the like which provides eye and face protection primarily from the sun when at a very low angle as during early morning and evening time periods.

Still another object of this invention is to provide a shade and weather shade which is attachable to and deployably downwardly from a rigid support margin of a bimini top or a T-top which will also provide protection to the eyes and face from rain when the boat is underway.

Yet another object of this invention is to provide a shade attachable to the rear margin of a T-top which also includes fishing devices attached to the rearward end of the T-top and which rearwardly extends therefrom.

Still yet another object of this invention is to provide a shade attachable to a side or end margin of a bimini top or a T-top of a boat which is easily pivotable, foldable or collapsible into a stored or not-in-use position or con figuration so as to be otherwise unobtrusive when stored.

In accordance with these and other objects which will become apparent hereinafter, the instant invention will now be described with reference to the accompanying drawings.

BRIEF DESCRIPTION OF THE SEVERAL VIEWS OF THE DRAWING(S)

DETAILED DESCRIPTION OF THE INVENTION

Figure 1:
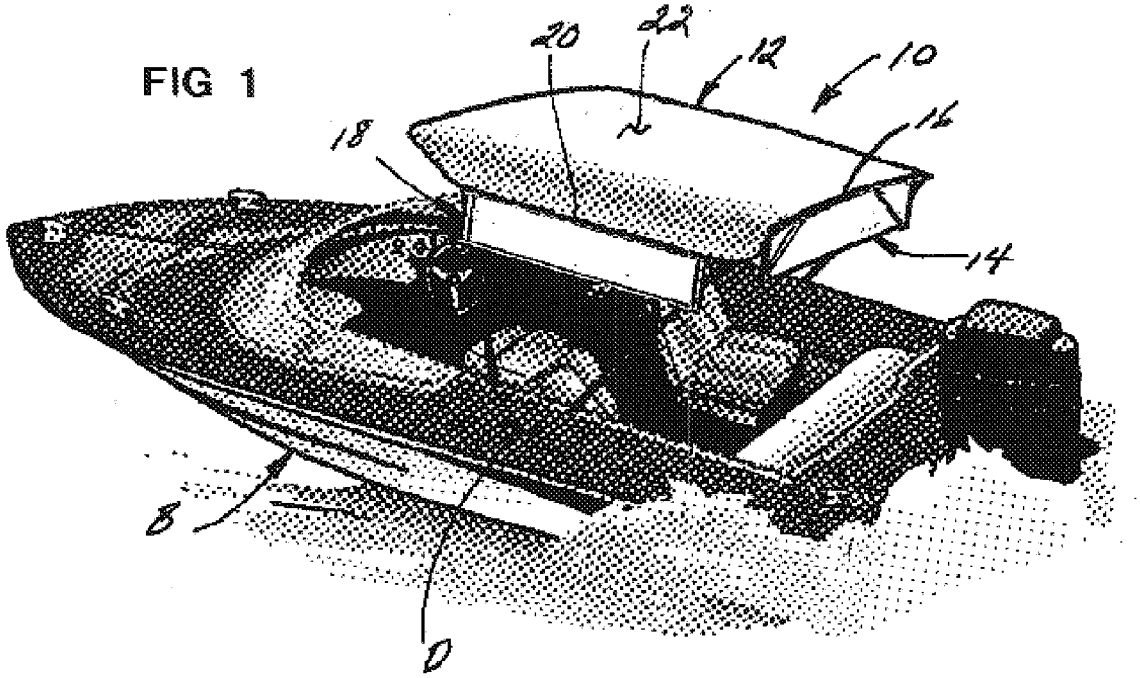
FIG. 1 is a pictorial schematic view of one aspect of the present invention in use on a flexible bimini top of a boat.

Referring now to the drawings, and particularly to FIG. 1, one aspect of the invention is there shown generally at numeral 10 in conjunction with a conventional flexible fabric bimini top 12 having frame formed tubular bows attached to the gunnel D of a boat B. The bimini top 12 typically includes flexible fabric material which is stretched and held in place over the tubular frame of bimini top 12.

Figure 3:
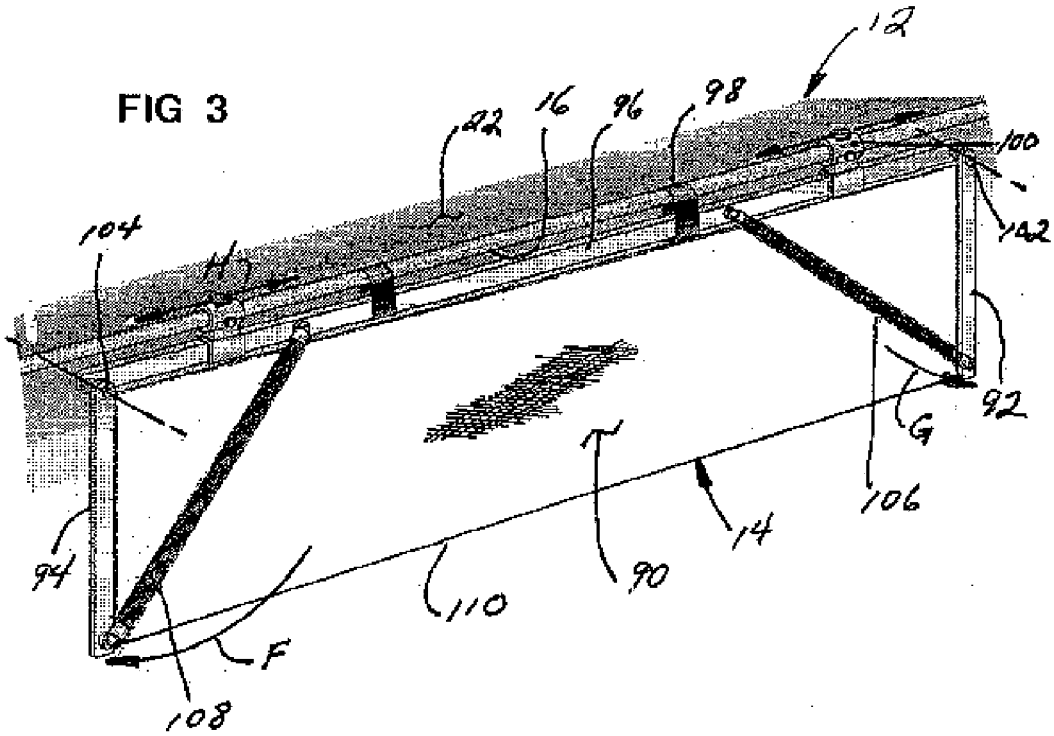
FIG. 3 is a perspective view of a collapsible embodiment of the invention in the deployed configuration.
Figure 4:
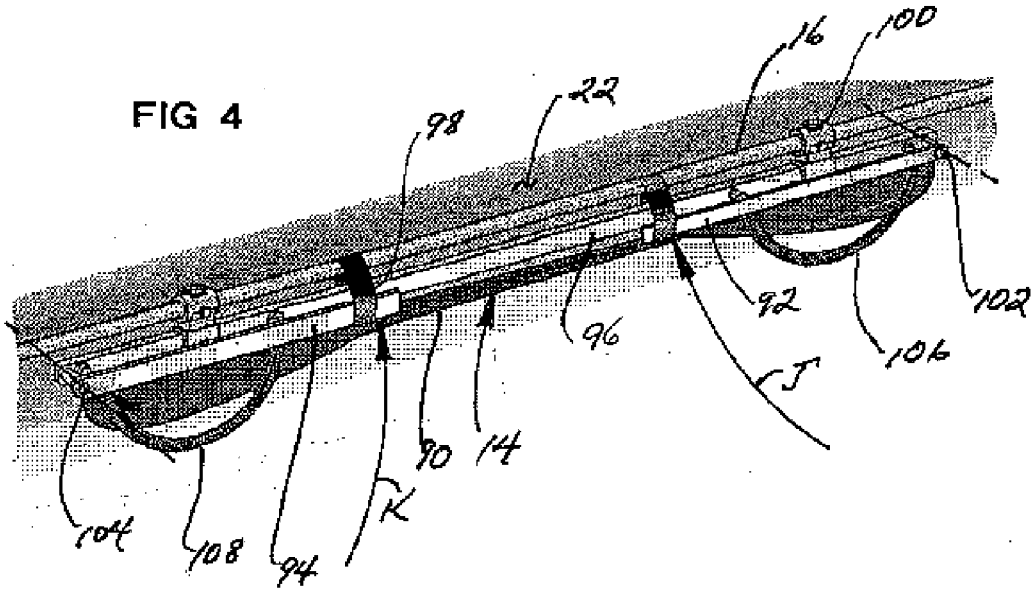
FIG. 4 is a view similar to FIG. 3 showing this embodiment in a collapsed or stored configuration.

In this embodiment 10, a low sun angle shade 14 is provided attached to the rearward tubular bow 16 of the bimini top 12 as described in more detail in FIGS. 3 and 4. A side sunshade 18 is also pivotally connected to a side margin 20 of the bimini top 12. Each of the shades 14 and 18, when pivotally or collapsibly downwardly deployed as shown, provides substantial eye and face protection for occupants of the boat B from low angle sun, reflected sunlight and rain when the boat B is underway.

Figure 2:
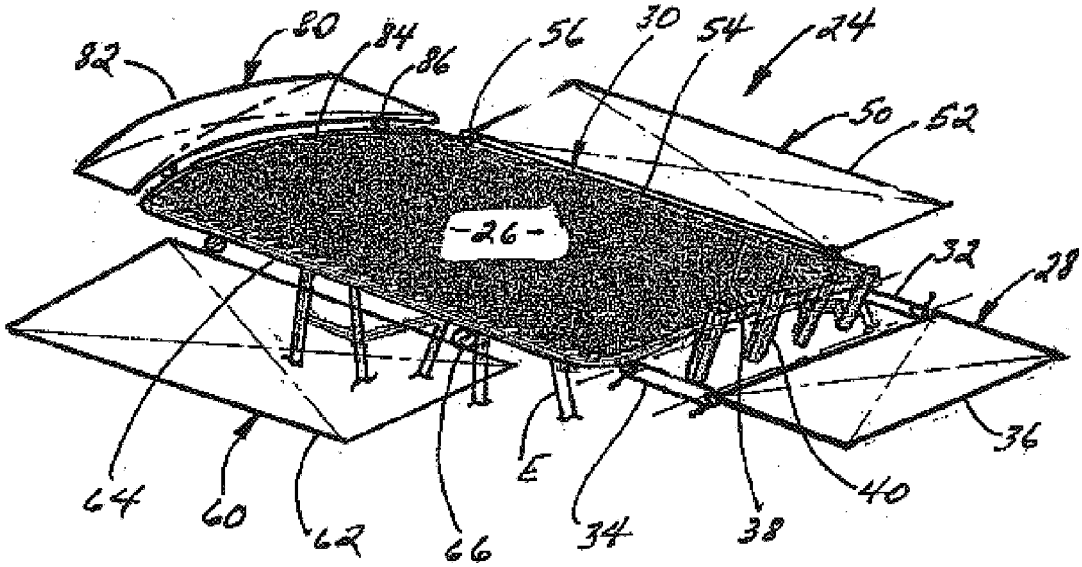
FIG. 2 is a schematic view of another aspect of the invention attached along both side margins and end margins of a rigid framed T-top of a boat.

Referring now to FIG. 2, a typical rigid-framed T-top 30 is there shown which is formed of rigid tubular members E welded together into the structure shown which is anchored to the deck of the boat and positioned above the console and central area of the boat. Opaque fabric 26 is typically stretched and held taught across the frame of such T-tops 30 for economy, serviceability and lighter weight structure.

In this embodiment 24 of FIG. 2, a shade 28 having a rigid open frame 36 covered with opaque material such as flexible canvas, plastic, vinyl or fiberglass sheet, is pivotally attached to and rearwardly positioned from fishing devices 40 which are attached to the rearward tubular margin 38 of the T-top 30. Two spaced extension brackets 32 and 34 are attached at forwardly ends thereof to the rearward margin 38 of the T-top 30 and are described in more detail with respect to FIGS. 7 and 8.

Side sunshades 50 and 60 also having rigid or semi-rigid open perimeter frames 52 and 62, respectively, are each pivotally connected by lockable pivotal members 56 and 66 to the side tubular margins 54 and 64, respectively, of the T-top 30 to provide the adjustable pivotal support and positioning of each of these side sunshades 50 and 60. A front sunshade 80 attached by pivotal locking connectors 86 to the forwardly tubular margin 84 of the T-top 30 is also provided.

Referring now to FIGS. 3 and 4, one embodiment of a collapsible, as opposed to a pivotally deployable and storable, embodiment is there shown generally at numeral 14 and as previously generally described with respect to FIG. 1. This embodiment 14 is formed having an elongated rigid or semi-rigid aluminum or plastic support member 96 which is attached to the rearward tubular frame member 16 of the bimini top 12. Flexible canvas fabric 22 extends over the frame members of the bimini top 12 as previously described.

Two spaced connecting members 100 provide for both lateral positioning of the sunshade 14 laterally in the direction of arrow H with respect to the rear frame member 16 and also provide for some pivotal movement in establishing the desired downward orientation of support member 96. Two downwardly pivotable elongated side frame members 92 and 94 are connected to the ends of support member 96 at pivotal connections 102 and 104 whereby the side frames 92 and 94 are pivotable to the deployed position in the direction of arrows F and G and are pivotable to the stored position shown in FIG. 4 in the direction of arrows J and K, respectively.

A flexible shade panel 90 formed of opaque material as previously described is attached along three of its generally rectangular margins along support member 96 and along side frames 92 and 94. When deployed as shown in FIG. 3, the free distal lower margin 110 is tensioned by tensioning members 106 and 108 which are pivotally attached between the lower distal end of each of the side frames 92 and 94 and to a central portion along the support members 96 as shown. In FIG. 4, VELCRO securing straps 98 hold the side members 92 and 94 and the flexible shade panel 90 in the stored position along side of the support member 96.

Figure 5:
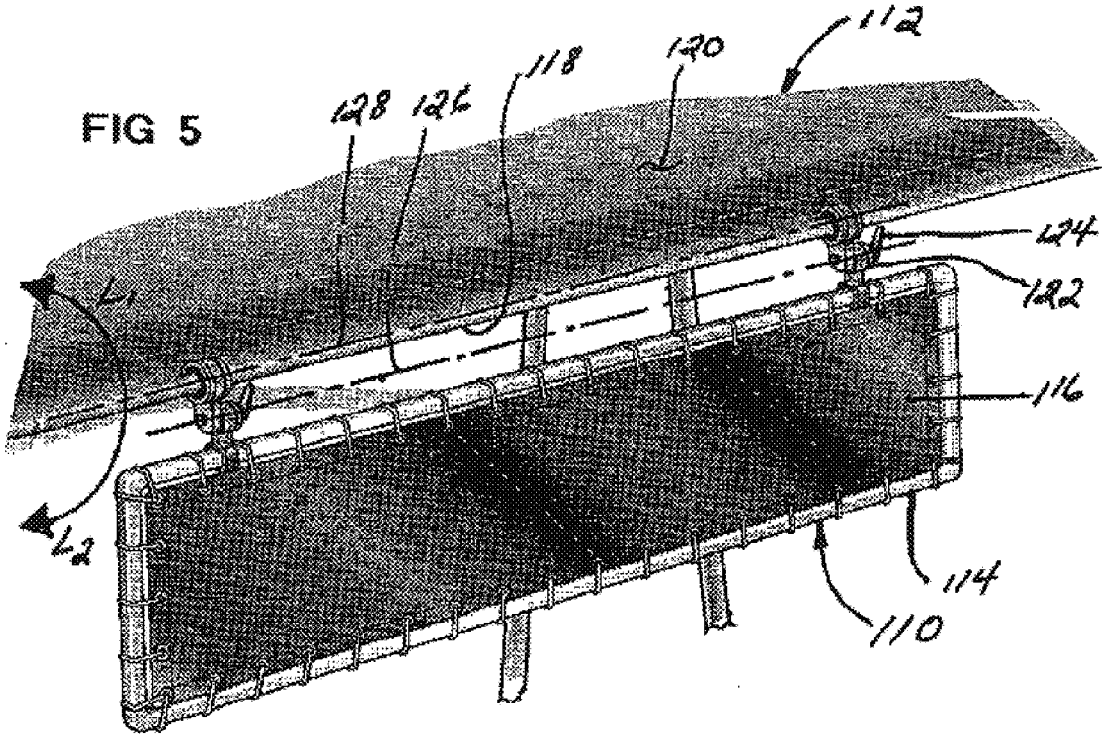
FIG. 5 is a perspective view of a rigid framed embodiment of the invention attached to a rigid side or end margin of a T-top.
Figure 6:
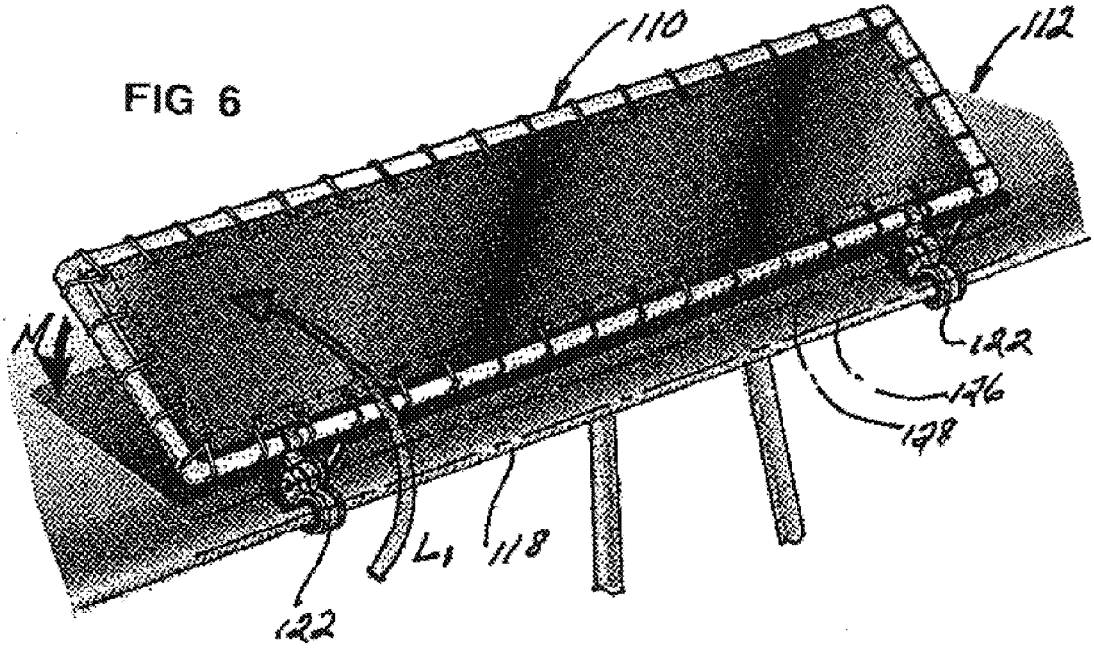
FIG. 6 is a view similar to FIG. 5 showing the pivotal storing movement of this embodiment.

Referring now to FIGS. 5 and 6, another embodiment of the invention is there shown generally at numeral 110 attached to a rearward or sideward tubular frame member 118 of a T-top 112. The shade 110 is formed having a rigid or semi-rigid aluminum, stainless steel, fiberglass, plastic or the like open rectangular perimeter frame 114 and having a flexible opaque canvas panel 116 taughtly stretched thereacross and held in place by plastic lacing material as shown. One longitudinal margin of the perimeter frame 114 is attached by two spaced connectors 122 of a conventional design which are both pivotable and then lockable in any desired relative angular orientation about axis 126 by locking handle 124. One end of each connector 122 is rigidly attached to the perimeter frame 114 while the other end of each connector 122 is attached adjacent to the side or end of tubular frame member 118 of bimini top 112. By this slight offset arrangement of each end of each locking connector 122, the sunshade 110 is pivotally connectable about axis 126 from the deployed to the stored position as depicted in FIG. 6 in the direction of arrow L1 or L2, respectively, while offset adjustment is achievable about axis 128 of connectors 122 attached to T-top frame member 118.

As seen in FIG. 6, the sunshade 110 may be stored by pivotal movement in the direction of arrow L1 and finally down to and against the upper surface 120 of T-top 112 in the direction of arrow M. However, the sunshade 110 may also be pivotally storable in the direction of L2 to a position against the underside of the T-top surface 120. The embodiment of the locking pivotal members 122 are in the form of an antenna base having a locking adjustment utilized for VHF boat antennas.

Figure 7:
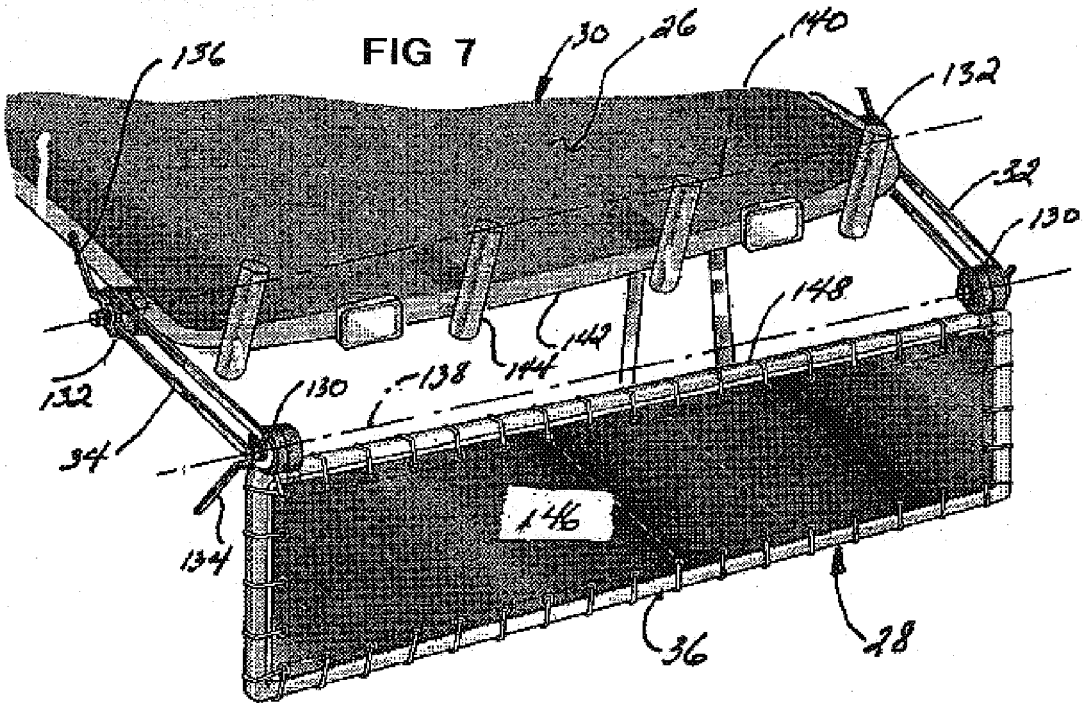
FIG. 7 is a perspective view of yet another embodiment of the invention attached to and positioned rearwardly of fishing devices attached to the rigid rearward margin of a T-top.
Figure 8:
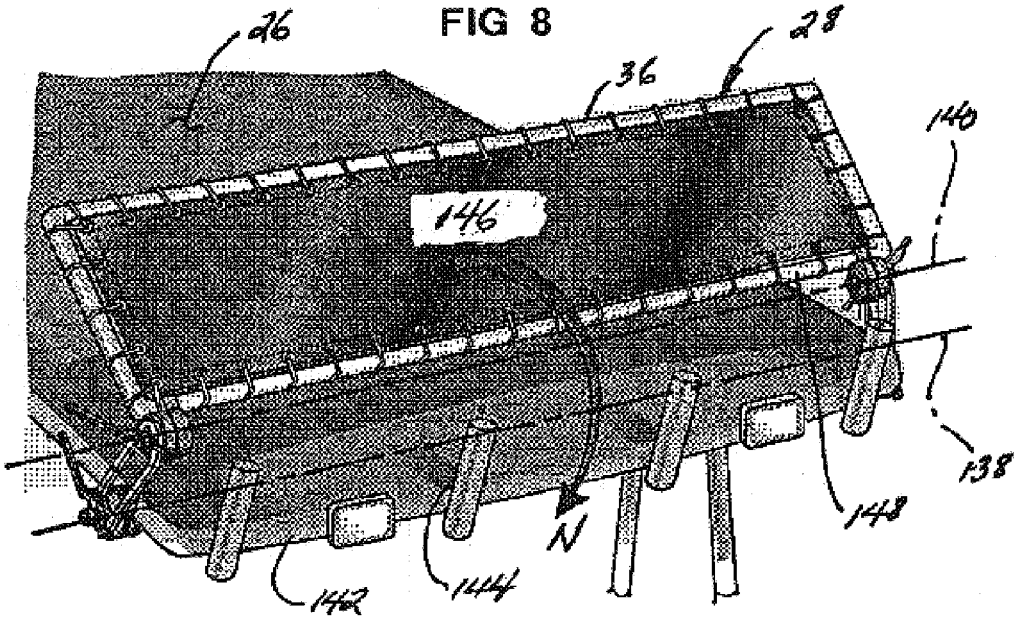
FIG. 8 is a view similar to FIG. 7 showing the pivotal deployment thereof from the stored position above the T-top.

Referring now to FIGS. 7 and 8, the previously generally described embodiment of the sunshade 28 in FIG. 2 is there shown in detail. This sunshade embodiment 28 is also formed of a rigid open perimeter frame 36 having a canvas or plastic opaque central surface 146 held in place by lacing material as shown.

This form of T-top 30 commonly includes fishing devices 144 which may be in the form of trolling fishing rod holders or what are referred to as "rocket launchers". These fishing devices 144 are typically permanently attached as by welding or clamping devices to the rear tubular margin 142 of the T-top 30. To provide adequate clearance for the proximal longitudinal margin 148 of perimeter frame 36, two spaced rigid extension arms 32 and 34 are provided. A proximal end of each of these arms 32 and 34 is connected to the tubular perimeter frame of the T-top 30 in the vicinity of the ends of the rearward T-top frame member 142 as shown. These connectors 132 have locking handles 136 which operatively engage mating serrations or teeth such as are found in a support base for VHF antennas as previously referenced. This form of connector 132 generally provides both rotational adjustability about axis 140 of the angular positioning of each of the extension arms 32 and 34 and then the locking engagement of the selected rotational orientation thereafter.

The distal or rearward portion of the extension arms 32 and 34 are likewise lockably positionable by connectors 130 having locking handles 134 associated therewith which operate in the same fashion as do the locking connectors 132 previously described. By this arrangement, the sunshade 28 is pivotally positionable and lockable in any desired deployed or stored position about a second transverse pivotal axis 138 which is spaced apart from, and preferably oriented parallel to the first pivotal axis 140.

As thus best seen in FIG. 8, the sunshade 28 is pivotally deployable from a stored position either above the T-top fabric 26 or therebeneath in the direction of arrow N so as to provide non-interfering clearance with respect to the fishing devices 144.

Figure 9:
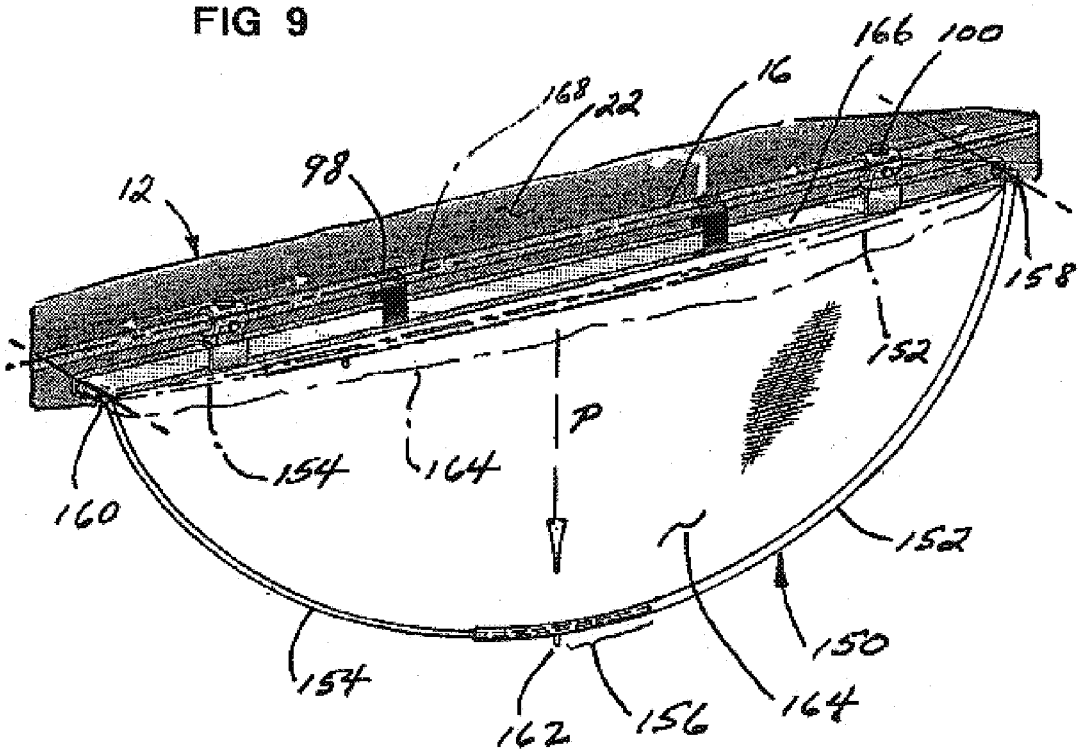
FIG. 9 is a perspective view of another collapsible embodiment of the invention.

Referring lastly to FIG. 9, another embodiment of a collapsible aspect of the invention is there shown generally at numeral 150. This sunshade embodiment 150 includes an elongated rigid support member 166 which is attached to the connectors 100 or 122 to frame member 16 of bimini top 12 as previously described. This sunshade 150 includes two elongated flexible, resilient hollow bows 152 and 154 which are connected to the ends of frame member 166 at pivotal connections 158 and 160, respectively. Bow 152 is larger in diameter than bow 154 so as to provide operative overlapping telescopic engagement therebetween in the area of 156. Locking pin 162 interacts between mating aligned apertures in the overlapping bow portions at 156 to secure the deployed configuration of these support bows 152 and 154 as shown. A sheet of flexible opaque material 164 is attached to the support member 166 and to each of the bows 152 and 154 in slidable sleeve-like fashion.

To deploy this sunshade 150, the user simply detaches VELCRO straps 98 and then pulls the central portion 156 downwardly in the direction of arrow P from the stored position of the bows 152 and 154 and opaque fabric material 164 (shown in phantom) and, when pin 162 is biasingly urged through preselected aligned apertures in the two distal portions of each of the bows 152 and 154, deployment is established. Pivotal storage of the collapsed configuration (shown in phantom) is further enhanced by the loosening of connectors 100 or 122 about bimini frame members 16 to allow for further pivotal movement about transverse pivotal axis 168.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

What is claimed is:

1. A low sun angle sunshade adapted to be attached to and carried on a bimini top or T-top for a boat, comprising:

a rigid perimeter frame supporting an elongated shade panel formed of substantially opaque material;

spaced pivotal connectors connected to an upper longitudinal margin of said perimeter frame adapted for attachment to, and selected pivotal movement of said perimeter frame and shade panel about a longitudinal axis substantially coextensive with, and adjacent to, said upper longitudinal margin and with respect to, a rigid side or end margin of the bimini top or T-top;

whereby said shade panel is selectively pivotally moveable about a said pivotal axis between a deployed downward position with respect to the bimini top or T-top wherein low-to-the-horizon sun is substantially blocked from a boat operator's eyes and a stored position doubled over and positioned against a corresponding side or end portion of the bimini top or T-top.

2. A low sun angle sunshade as set forth in claim 1 wherein a rear transverse margin of the T-top carries fishing devices mounted thereon which rearwardly extend therefrom, said sunshade further comprising:

a pair of spaced apart rigid extension arms, each of which include at a forwardly end thereof, one said pivotal connector whereby said extension arms are selectively pivotable about a first pivotal axis and lockable in a selected orientation;

a rearward end of each said extension arm pivotally connected to and supporting said shade panel about a second pivotal axis spaced apart from and substantially parallel to said first pivotal axis to provide clearance between the fishing devices and said shade panel.

3. A low sun angle sunshade adapted to be attached to and carried on a bimini top or T-top for a boat, comprising:

an elongated shade panel formed of flexible substantially opaque material attached to, and supported by, a rigid upper longitudinal frame member;

spaced pivotal connectors on said longitudinal frame member adapted for attachment to, and selected pivotal movement of said shade panel with respect to, a longitudinal axis substantially parallel to said longitudinal frame member and a rigid side or end margin of the bimini top or T-top whereby said shade panel is selectively pivotally moveable about a pivotal axis passing through said pivotal connectors between a deployed outstretched downward position with respect to the bimini top or T-top wherein low-to-the-horizon sun is substantially blocked from a boat operators eyes and a stored collapsed position against the side or end of the bimini top or T-top.

4. A low sun angle sunshade adapted to be attached to and carried on a horizontal open-sided top positioned and secured to a vehicle overhead of an occupant or driver of the vehicle, comprising:

an elongated shade panel formed of substantially opaque material supportively attached to a rigid longitudinal frame member along an upper margin of said shade panel, a lower distal margin of said shade panel being unsupported;

spaced pivotal connectors connected to said longitudinal frame member adapted for attachment to, and selected pivotal movement of said shade panel about a longitudinal pivotal axis coextensive with said longitudinal frame member and substantially parallel to, a rigid side or end margin of the vehicle top whereby said shade panel is selectively pivotally moveable about a pivotal axis passing through said pivotal connectors between a deployed downward position with respect to the vehicle top wherein low-to-the-horizon sun is substantially blocked from the eyes of the occupant or drive and a stored position doubled over and positioned against a corresponding side or end portion of the vehicle top.

5. A low sun angle sunshade adapted to be attached to and carried on a bimini top or T-top for a boat, comprising:

an elongated shade panel formed of substantially opaque material supported on a rigid longitudinal frame member which defines an upper longitudinal margin of said sunshade;

spaced pivotal connectors each pivotally connected at a first end thereof to said longitudinal frame member and adapted for pivotal attachment at a second end thereof to a rigid side or end margin of the bimini top or T-top whereby said shade panel is selectively pivotally moveable independently about a first pivotal axis passing through said first end of said pivotal connectors or about a second pivotal axis passing through said second ends of said pivotal connectors between a deployed downward position with respect to the bimini top or T-top wherein low-to-the-horizon sun is substantially blocked from a boat operator's eyes and a stored position doubled over and positioned against a corresponding side or end portion of the bimini top or T-top.

* * * * *